US010459360B2

(12) United States Patent
Suzuki et al.

(10) Patent No.: US 10,459,360 B2
(45) Date of Patent: Oct. 29, 2019

(54) TONER AND IMAGE FORMING METHOD

(71) Applicants: Namie Suzuki, Shizuoka (JP); Hisashi Nakajima, Shizuoka (JP); Kazumi Suzuki, Shizuoka (JP); Yoshitaka Yamauchi, Shizuoka (JP)

(72) Inventors: Namie Suzuki, Shizuoka (JP); Hisashi Nakajima, Shizuoka (JP); Kazumi Suzuki, Shizuoka (JP); Yoshitaka Yamauchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/879,495

(22) Filed: Jan. 25, 2018

(65) Prior Publication Data

US 2018/0259864 A1 Sep. 13, 2018

(30) Foreign Application Priority Data

Mar. 13, 2017 (JP) ..... 2017-047256

(51) Int. Cl.
*G03G 9/087* (2006.01)
*G03G 9/08* (2006.01)
(Continued)

(52) U.S. Cl.
CPC ..... *G03G 9/08755* (2013.01); *G03G 9/0806* (2013.01); *G03G 9/0827* (2013.01);
(Continued)

(58) Field of Classification Search
CPC .. G03G 9/08755; G03G 9/0827; G03G 13/22; G03G 9/0902; G03G 9/08782; G03G 9/0806; G03G 21/10
See application file for complete search history.

(56) References Cited

U.S. PATENT DOCUMENTS

2003/0207186 A1* 11/2003 Itakura ..... G03G 9/0821 430/45.5
2006/0029433 A1 2/2006 Saito et al.
(Continued)

FOREIGN PATENT DOCUMENTS

JP 2003-233217 8/2003
JP 2005-266753 9/2005
(Continued)

OTHER PUBLICATIONS

U.S. Appl. No. 15/567,631, filed Mar. 24, 2016 Yoshitaka Yamauchi, et al.
(Continued)

*Primary Examiner* — Thorl Chea
(74) *Attorney, Agent, or Firm* — Oblon, McClelland, Maier & Neustadt, L.L.P.

(57) ABSTRACT

A toner is provided. The toner comprises a binder resin comprising a polyester resin, a release agent comprising an ester wax, and a wax dispersing agent comprising a hybrid resin. The hybrid resin comprises a condensation polymerization resin unit and an addition polymerization resin unit. The condensation polymerization resin unit comprises a condensation polymerization product of an aromatic alcohol component and a carboxylic acid component, and the carboxylic acid component comprises an aliphatic dicarboxylic acid having 9 to 14 carbon atoms. The addition polymerization resin unit comprises an addition polymerization product of a styrene monomer.

11 Claims, 3 Drawing Sheets

(51) Int. Cl.
*G03G 9/09* (2006.01)
*G03G 13/22* (2006.01)
*G03G 21/10* (2006.01)

(52) U.S. Cl.
CPC ..... *G03G 9/08782* (2013.01); *G03G 9/08795* (2013.01); *G03G 9/08797* (2013.01); *G03G 9/0902* (2013.01); *G03G 13/22* (2013.01); *G03G 21/10* (2013.01)

(56) References Cited

U.S. PATENT DOCUMENTS

| | | | | |
|---|---|---|---|---|
| 2008/0171280 | A1* | 7/2008 | Ohmura | G03G 9/0804 430/109.4 |
| 2008/0241717 | A1* | 10/2008 | Kunii | G03G 9/08755 430/48 |
| 2009/0239170 | A1 | 9/2009 | Honda et al. | |
| 2010/0021209 | A1 | 1/2010 | Watanabe et al. | |
| 2010/0068644 | A1 | 3/2010 | Nakajima et al. | |
| 2011/0281214 | A1* | 11/2011 | Kuroyama | G03G 9/08755 430/110.4 |
| 2013/0244162 | A1* | 9/2013 | Yamada | G03G 9/08755 430/108.2 |
| 2016/0327884 | A1 | 11/2016 | Nakajima et al. | |
| 2017/0139337 | A1 | 5/2017 | Kaneko et al. | |

FOREIGN PATENT DOCUMENTS

| | | |
|---|---|---|
| JP | 2015-068859 | 4/2015 |
| JP | 2015-166766 | 9/2015 |
| JP | 2016-114824 | 6/2016 |
| JP | 2016-186519 | 10/2016 |
| JP | 2017-009631 | 1/2017 |

OTHER PUBLICATIONS

U.S. Appl. No. 15/696,818, filed Sep. 6, 2017 Yoshitaka Yamauchi, et al.

* cited by examiner

TONER AND IMAGE FORMING METHOD

CROSS-REFERENCE TO RELATED APPLICATIONS

This patent application is based on and claims priority pursuant to 35 U.S.C. § 119(a) to Japanese Patent Application No. 2017-047256, filed on Mar. 13, 2017, in the Japan Patent Office, the entire disclosure of which is hereby incorporated by reference herein.

BACKGROUND

Technical Field

The present disclosure relates to a toner and an image forming method.

Description of the Related Art

In recent years, toner is required to be fixable at low temperatures in electrophotography. This requirement has arisen from the demand for saving energy by reducing energy required for fixing image, and also from the demand for electrophotographic image forming apparatus having a higher processing speed and smaller size, and outputting an image of higher image quality.

Generally, the image quality deteriorates as the speed is raised and the size is reduced. There are various reasons for this phenomenon. Among them, a fixing failure that may occur in the fixing process is a great cause.

In the fixing process, an unfixed toner image is fixed on a recording medium, such as a paper sheet, by heat and pressure. As the system speed becomes higher, the unfixed toner image cannot receive a sufficient amount of heat in the fixing process. As a result, a fixing failure occurs, causing a rough surface of the fixed toner image or a defective image containing a residual image called cold offset. In order not to degrade image quality by raising the system speed, the fixing temperature can be raised. However, raising the fixing temperature is not the best measure, because heat leaking from the fixing device adversely affects other processes in the image forming apparatus, the wear speed of the fixing member is accelerated, and the amount of consumed energy is increased.

In particular, in high-speed image forming apparatus, toner itself is required to improve fixing performance. More specifically, toner fixable at much lower temperatures is demanded.

Various attempts have been made so far for improving fixability of toner. For example, controlling thermal properties (e.g., glass transition temperature (Tg) and softening temperature (T1/2)) of the binder resin of toner is known as one method for improving fixability of toner. On the other hand, lowering of Tg of the resin may deteriorate heat-resistant storage stability of the toner, and lowering of T1/2 by lowering the molecular weight of the resin may cause a problem such as hot offset. Toner satisfying all of low-temperature fixability, heat-resistant storage stability, and hot offset resistance has never been obtained by simply controlling thermal properties of the resin.

SUMMARY

In accordance with some embodiments of the present invention, a toner is provided. The toner comprises a binder resin comprising a polyester resin, a release agent comprising an ester wax, and a wax dispersing agent comprising a hybrid resin. The hybrid resin comprises a condensation polymerization resin unit and an addition polymerization resin unit. The condensation polymerization resin unit comprises a condensation polymerization product of an aromatic alcohol component and a carboxylic acid component, and the carboxylic acid component comprises an aliphatic dicarboxylic acid having 9 to 14 carbon atoms. The addition polymerization resin unit comprises an addition polymerization product of a styrene monomer.

In accordance with some embodiments of the present invention, an image forming method is provided. The method includes the steps of: charging a to-be-charged body; forming an electrostatic latent image on the to-be-charged body having been charged; developing the electrostatic latent image into a toner image with the above toner; transferring the toner image onto a transferor; cleaning a surface of the to-be-charged body with a cleaning member; and fixing the toner image.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
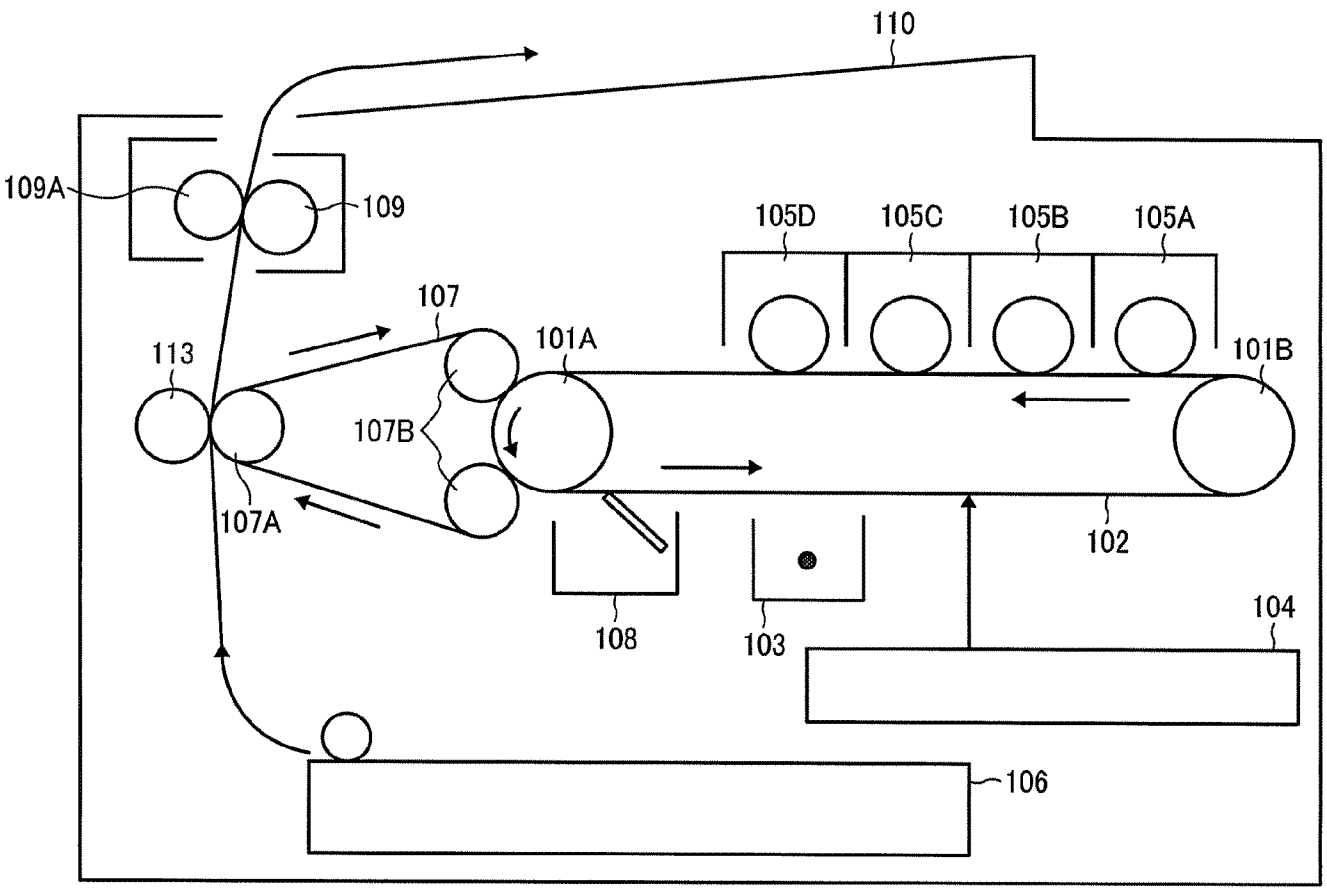
FIG. 1 is a schematic view of a full-color image forming apparatus used for an image forming method in accordance with some embodiments of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, a toner is provided that has excellent low-temperature fixability and a good combination of high hot offset resistance, high durability, and heat-resistant storage stability, and is capable of forming high-quality image for an extended period of time.

In recent years, toner is required to be fixable at low temperatures in electrophotography, as described above. This requirement has arisen from the demand for saving energy by reducing energy required for fixing image, and also from the demand for electrophotographic image forming apparatus having a higher speed, smaller size, and higher image quality, based on recent diversification of use purpose of electrophotographic image forming apparatus.

It is possible to make toner be fixable at lower temperatures by simply lowering the softening temperature (T1/2) of the toner. As the softening temperature is lowered, however, the glass transition temperature is also lowered, resulting in deterioration of heat-resistant storage stability. Furthermore, not only the lower-limit fixable temperature is lowered without adversely affecting image quality, but also the upper-limit fixable temperature is lowered, resulting in deterioration of hot offset resistance. It has been very difficult to obtain a toner satisfying all of low-temperature fixability, heat-resistant storage stability, and hot offset resistance.

In view of this situation, the inventors of the present invention have achieved the present invention.

A toner in accordance with some embodiments of the present invention comprises a binder resin, a release agent, and a wax dispersing agent. The binder resin comprises a polyester resin. The release agent comprises an ester wax. The wax dispersing agent comprises a hybrid resin comprising a condensation polymerization resin unit and an addition polymerization resin unit. The condensation polymerization resin unit comprises a condensation polymerization product of an aromatic alcohol component and a carboxylic acid component comprising an aliphatic dicarboxylic acid having 9 to 14 carbon atoms. The addition polymerization resin unit comprises an addition polymerization product of a styrene monomer.

Binder Resin

The binder resin comprises a polyester resin, for improving low-temperature fixability and environmental safety (free of volatile organic compounds (VOC) derived from residual monomer).

Polyester Resin

Examples of the polyester resin include all possible polycondensation products between alcohols and acids.

Specific examples of the alcohol include, but are not limited to: diols such as polyethylene glycol, diethylene glycol, triethylene glycol, 1,2-propylene glycol, 1,3-propylene glycol, 1,4-propylene glycol, neopentyl glycol, and 1,4-butenediol; etherified bisphenols such as 1,4-bis(hydroxymethyl)cyclohexane, bisphenol A, hydrogenated bisphenol A, polyoxyethylenated bisphenol A, and polyoxypropylenated bisphenol A; divalent alcohol monomers obtained by substituting the above compounds with a saturated or unsaturated hydrocarbon group having 3 to 22 carbon atoms; other divalent alcohol monomers; and trivalent or greater valences of alcohol monomers such as sorbitol, 1,2,3,6-hexanetetraol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Specific examples of carboxylic acids for preparing the polyester resin include, but are not limited to: monocarboxylic acids such as palmitic acid, stearic acid, and oleic acid; maleic acid, fumaric acid, mesaconic acid, citraconic acid, terephthalic acid, cyclohexanedicarboxylic acid, succinic acid, adipic acid, sebacic acid, and malonic acid, and divalent organic acid monomers obtained by substituting these compounds with a saturated or unsaturated hydrocarbon group having 3 to 22 carbon atoms; anhydrides of these acids; dimers of lower alkyl esters and linolenic acid; 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, and enpol trimer acid; and polyvalent (i.e., trivalent or greater valences of) carboxylic acid monomers such as anhydrides of the above acids.

Preferably, the polyester resin has a weight average molecular weight (Mw) of from 9,500 to 30,000 and a number average molecular weight (Mn) of from 2,100 to 2,300. Mw and Mn can be measured by gel permeation chromatography (GPC).

Release Agent

The toner comprises a release agent comprising an ester wax. The ester wax has a low compatibility with the polyester resin. Therefore, the ester wax easily exudes out from the surface of the toner when the toner is fixed, providing high releasability and sufficient low-temperature fixability.

Preferably, the content of the ester wax in 100 parts by mass of the toner is from 4 to 8 parts by mass, more preferably from 5 to 7 parts by mass. When the content is 4 parts by mass or more, a sufficient amount of the release agent exudes out from the surface of the toner when the toner is fixed, thereby improving releasability, low-temperature fixability, and hot offset resistance. When the content is 8 parts by mass or less, the amount of the release agent deposited on the surface of the toner image does not excessively increase, thereby improving storage stability and filming resistance on a photoconductor, etc., of the toner.

Preferred examples of the ester wax include a synthetic monoester wax. Examples of the synthetic monoester wax include, but are not limited to, a monoester wax synthesized from a long-chain straight-chain saturated fatty acid and a long-chain straight-chain saturated alcohol. Preferred examples of the long-chain straight-chain saturated fatty acid include a straight-chain saturated monocarboxylic acid represented by the general formula $C_nH_{2n+1}COOH$, where n is preferably from 5 to 30, more preferably from 13 to 29. Preferred examples of the long-chain straight-chain saturated alcohol include a straight-chain saturated monovalent alcohol represented by the general formula $C_nH_{2n+1}OH$, where n is preferably from 5 to 30, more preferably from 14 to 30.

Specific examples of the long-chain straight-chain saturated fatty acid include, but are not limited to, capric acid, undecylic acid, lauric acid, tridecylic acid, myristic acid, pentadecylic acid, palmitic acid, heptadecanoic acid, tetradecanoic acid, stearic acid, nonadecanoic acid, arachidic acid, behenic acid, lignoceric acid, cerotic acid, heptacosanoic acid, montanic acid, and melissic acid. Specific examples of the long-chain straight-chain saturated alcohol include, but are not limited to, amyl alcohol, hexyl alcohol, heptyl alcohol, octyl alcohol, capryl alcohol, nonyl alcohol, decyl alcohol, undecyl alcohol, lauryl alcohol, tridecyl alcohol, myristyl alcohol, pentadecyl alcohol, cetyl alcohol, heptadecyl alcohol, stearyl alcohol, nonadecyl alcohol, eicosyl alcohol, ceryl alcohol, and heptadecanol, all of which may have a substituent such as a lower alkyl group, amino group, and halogen.

Wax Dispersing Agent

The toner further comprises a wax dispersing agent. The wax dispersing agent comprises a hybrid resin comprising a condensation polymerization resin unit and an addition polymerization resin unit. The condensation polymerization resin unit comprises a condensation polymerization product of an aromatic alcohol component and a carboxylic acid component comprising an aliphatic dicarboxylic acid having 9 to 14 carbon atoms. The addition polymerization resin unit comprises an addition polymerization product of a styrene monomer.

Preferred examples of the aromatic alcohol component in the condensation polymerization resin unit include a compound represented by the following formula (1).

Formula (1)

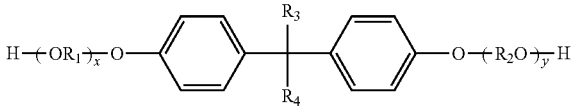

In the formula (1), each of $R_1$ and $R_2$ independently represents an alkylene group having 2 to 4 carbon atoms, such as ethylene group and propylene group. Each of $R_3$ and $R_4$ independently represents a hydrogen atom or a straight-chain or branched alkyl group having 1 to 6 carbon atoms, such as methyl group, ethyl group, propyl group, isopropyl group, butyl group, t-butyl group, and hexyl group. Each of x and y independently represents a positive integer where the sum of x and y is from 1 to 16, preferably from 2 to 6. Total alcohol components may further include a polyol other than the aromatic alcohol component.

Preferred examples of the carboxylic acid component comprising an aliphatic dicarboxylic acid having 9 to 14 carbon atoms include a straight-chain alkanedicarboxylic acid such as azelaic acid, sebacic acid, dodecanedioic acid, and tetradecanedioic acid. Total carboxylic acid components may further include a polycarboxylic acid compound other than the carboxylic acid component comprising an aliphatic dicarboxylic acid having 9 to 14 carbon atoms. Specific examples of the polycarboxylic acid compound include, but are not limited to, oxalic acid, malonic acid, maleic acid, fumaric acid, citraconic acid, itaconic acid, glutaconic acid, succinic acid, adipic acid, an aliphatic dicarboxylic acid (e.g., succinic acid) substituted with an alkyl group having 1 to 30 carbon atoms or an alkenyl group having 2 to 30 carbon atoms, an aromatic dicarboxylic acid (e.g., phthalic acid, isophthalic acid, and terephthalic acid), an alicyclic dicarboxylic acid (e.g., cyclohexanedicarboxylic acid), a trivalent or greater valence of aromatic carboxylic acid (e.g., trimellitic acid, 2,5,7-naphthalenetricarboxylic acid, and pyromellitic acid), and an anhydride or an alkyl ester having 1 to 3 carbon atoms of these compounds.

Specific examples of the styrene monomer in the addition polymerization resin unit include, but are not limited to, styrene-based vinyl monomers such as styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-4-dichlorostyrene, m-nitrostyrene, o-nitrostyrene, and p-nitrostyrene. The addition polymerization resin unit may further comprise acrylic and/or methacrylic monomers, such as acrylic vinyl monomers (e.g., acrylic acid, methyl acrylate, ethyl acrylate, propyl acrylate, n-butyl acrylate, isobutyl acrylate, n-octyl acrylate, and 2-ethylhexyl acrylate) and methacrylic vinyl monomers (e.g., methacrylic acid, methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate, and diethylaminoethyl methacrylate). Other vinyl monomers may also be used in combination with the above monomers.

The condensation polymerization resin unit and the addition polymerization resin unit may be chemically bound to each other using a reactive monomer capable of both condensation-polymerizing and addition-polymerizing (hereinafter "bireactive monomer").

Specific examples of the bireactive monomer include, but are not limited to: unsaturated carboxylic acids such as acrylic acid and methacrylic acid; unsaturated dicarboxylic acids, such as fumaric acid, maleic acid, citraconic acid, and itaconic acid, and anhydrides thereof; and hydroxyl-group-containing vinyl monomers.

The content of the bireactive monomer in the addition polymerization resin unit is preferably from 1 to 25 parts by mass, more preferably from 2 to 20 parts by mass, based on 100 parts by mass of all the monomers.

The hybrid resin may be obtained by subjecting a mixture of monomers of the condensation polymerization resin unit and the addition polymerization resin unit to a condensation polymerization reaction and an addition polymerization reaction simultaneously. Alternatively, the mixture of monomers can be subjected to a condensation polymerization reaction and an addition polymerization reaction sequentially regardless of the order.

The molar ratio of the monomers of the condensation polymerization resin unit in the hybrid resin is preferably from 30% to 90% by mol, more preferably from 50% to 70% by mol.

The hybrid resin has a better compatibility with the ester wax compared to the polyester resin (binder resin). Therefore, the ester wax is more difficult to be dispersed in the hybrid resin. The hybrid resin has a weak internal cohesive force and a better pulverizability than the polyester resin. Therefore, compared to the polyester resin, it is less likely for the hybrid resin that the interface with the wax becomes a pulverization surface. The hybrid resin is capable of suppressing the amount of the ester wax present at the surface of the toner and improving heat-resistant storage stability of the toner.

It is easy to make thermal properties of the hybrid resin similar to those of the polyester resin. The hybrid resin does not largely disturb low-temperature fixability and internal cohesive force of the polyester resin.

The content of the wax dispersing agent in 100 parts by mass of the toner is preferably 8 parts by mass or less, more preferably from 3 to 6 parts by mass. The wax dispersing agent effectively disperses the ester wax in the toner, so that the toner stably exhibits excellent heat-resistant storage stability regardless of production method of the toner. As the ester wax is dispersed with a smaller diameter, the toner is more suppressed from filming on a to-be-charged body such as photoconductor. When the content is 8 parts by mass or greater, polyester-incompatible components increase in amount and wax dispersibility becomes excessively high. Therefore, it becomes much easier for the wax to exude from the surface of the toner when the toner is fixed, resulting in deterioration of low-temperature fixability and hot offset resistance, although filming resistance is improved.

Colorant

The toner may contain a colorant. Examples of the colorant include, but are not limited to, pigments and dyes such as carbon black, lamp black, iron black, aniline blue, phthalocyanine blue, phthalocyanine green, Hansa Yellow G, Rhodamine 6C Lake, Calco Oil Blue, chrome yellow, quinacridone, benzidine yellow, rose bengal, and triarylmethane dyes. Each of these colorants can be used alone or in combination with others. The toner may be used for either black-and-white printing or full-color printing.

Other Components

External Additive

The toner may further contain an external additive.

Specific examples of the external additive include, but are not limited to: abrasive agents such as silica, TEFLON (registered trademark) resin powder, polyvinylidene fluoride powder, cerium oxide powder, silicon carbide powder, and strontium titanate; fluidity imparting agents such as titanium oxide powder and aluminum oxide powder; aggregation preventing agents; conductivity imparting agents such as resin powder, zinc oxide powder, antimony oxide powder, and tin oxide powder; and developability improving agents such as reverse-polarity white particles or black particles. Each of these materials can be used alone or in combination with others. The external additive is so selected that the toner is imparted with resistance to stress caused by, for example, idling in the developing process.

Developer

The toner may be used in combination with a magnetic carrier comprising magnetic fine particles in a two-component developing method. Specific examples of the magnetic fine particles include, but are not limited to: magnetites; spinel ferrites containing gamma iron oxide; spinel ferrites containing at least one metal (e.g., Mn, Ni, Zn, Mg, and Cu) other than iron; magnetoplumbite-type ferrites such as barium ferrite; and particulate iron or alloy having an oxidized layer on its surface. The magnetic fine particles may have either a granular, spherical, or needle-like shape. When high magnetization is required, ferromagnetic fine particles, such as iron, are preferably used. From the viewpoint of chemical stability, magnetites, spinel ferrites containing gamma iron oxide, and magnetoplumbite-type ferrites such as barium ferrite are preferable.

A resin carrier having a desired magnetization, by containing an appropriate type of magnetic fine particles in an appropriate amount, may also be used. Such a resin carrier preferably has a magnetization strength of from 30 to 150 emu/g at 1,000 oersted.

The resin carrier may be produced by spraying a melt-kneaded product of magnetic fine particles with an insulating binder resin by a spray dryer, or dispersing magnetic fine particles in a condensation binder resin by reacting/curing its monomer or prepolymer in an aqueous medium in the presence of magnetic fine particles.

Chargeability of the magnetic carrier may be controlled by fixing positively-chargeable or negatively-chargeable fine particles or conductive fine particles on the surface of the magnetic carrier, or coating the magnetic carrier with a resin.

Examples of the surface coating resin include silicone resin, acrylic resin, epoxy resin, and fluororesin. These resins may contain positively-chargeable or negatively-chargeable fine particles or conductive fine particles. Among these resins, silicone resin and acrylic resin are preferable.

Preferably, the mixing ratio of the toner to the magnetic carrier is from 2% to 10% by mass.

Toner Properties

Volume Average Particle Diameter of Toner

Volume average particle diameter of the toner can be measured by various methods, for example, by using an instrument COULTER COUNTER MULTISIZER III in the following manner. First, the toner is dispersed in an electrolytic solution containing a surfactant by an ultrasonic disperser for one minute. Next, 50,000 toner particles dispersed therein are subjected to a measurement of volume average particle diameter by the above instrument.

Preferably, the volume average particle diameter (Dv) of the toner is from 1.2 to 2.0 times the average particle diameter of the colorant. When the average particle diameter of the toner is too large, hiding power of the colorant is lowered and glittering property is lost. When the particle size of the toner is too small, the colorant may project out from the toner, degrading functions of the toner.

Average Circularity of Toner

Preferably, the toner has an average circularity of 0.95 or less for cleanability. When the average circularity of the toner is larger than 0.95, particularly when the toner is used in a system employing blade cleaning, a photoconductor or transfer belt may not be cleaned sufficiently and the resulting image may be contaminated with residual toner particles. After developing or transferring an image having a low image area rate, residual toner particles are small in amount and no problem will occur. On the other hand, after developing or transferring a full-color photographic image having a high image area rate, or when sheet feeding failure has occurred, residual toner particles may remain and accumulate on a to-be-charged body, such as photoconductor, causing background fouling in the image. Such residual toner particles may also contaminate a charger (e.g., charging roller) for charging the to-be-charged body, thus preventing the charger from exerting its charging ability.

The average circularity of the toner can be measured with a flow particle image analyzer FPIA-3000 (available from Sysmex Corporation) in the following manner. First, 0.1 to 0.5 ml of a surfactant, preferably an alkylbenzene sulfonate, serving as a dispersant, is added to 100 to 150 ml of water from which solid impurities have been removed, and further 0.1 to 0.5 g of a sample (toner) is added thereto. The resulting suspension liquid in which the sample is dispersed is subjected to a dispersion treatment by an ultrasonic disperser for 1 to 3 minutes. The resulting dispersion liquid containing 3,000 to 10,000 toner particles/μl is subjected to a measurement of toner shape by the above instrument.

Dispersion Diameter of Ester Wax in Toner

Preferably, the ester wax has a dispersion diameter of from 0.1 to 0.5 μm in the toner for releasability and storage stability. When the dispersion diameter is greater than 0.5 μm, storage stability of the toner deteriorates and filming resistance on the photoconductor may also deteriorate. When the dispersion diameter is less than 0.1 μm, the wax cannot easily exude out from the surface of the toner when the toner is fixed, thus lowering the upper-limit fixable temperature and degrading hot offset resistance.

In the present disclosure, the dispersion diameter of the ester wax refers to a circle-equivalent average diameter of the ester wax in the toner. The dispersion diameter of the ester wax can be measured with an image analysis software program A-ZOU KUN (available from Asahi Kasei Engineering Corporation) in the following manner.

First, the toner is embedded in an epoxy resin and a cross-section thereof is cut out with a microtome. The cross-section of the toner is dyed with ruthenium and observed with an Ultra-high Resolution Scanning Electron Microscope (cold) SU8230 (available from Hitachi High-Technologies Corporation) at a magnification of 5,000 times. The reflected electron image is input in the image analysis software program A-ZOU KUN (available from Asahi Kasei Engineering Corporation) at a scale unit of μm. The ruthenium-dyed particle portions are subjected to an analysis (i.e., binarization) to calculate the circle-equivalent average diameter.

Endothermic Quantity of Endothermic Peak of Toner

When the endothermic quantity of the endothermic peak of the toner is less than 3 J/g, it means that the amount of wax contained in the toner is too small. In this case, the wax cannot exude out from the surface of the toner sufficiently when the toner is fixed, thus degrading releasability and causing winding of a recording medium around a fixing roller. When the endothermic quantity of the endothermic peak of the toner is in excess of 10 J/g, it means that the amount of wax contained in the toner is excessive, so that the wax present at the surface of the toner is increased in amount, thus degrading storage stability and filming resistance. Thus, the endothermic quantity of the endothermic peak of the toner is preferably from 3 to 10 J/g, more preferably from 4.0 to 7.0 J/g.

The endothermic quantity of the endothermic peak of the toner can be measured by differential scanning calorimetry (DSC).

Toner Production Method

The toner in accordance with some embodiments of the present invention may be produced by a dry method such as kneading-pulverizing or a wet method such as dissolution suspension and emulsion aggregation.

The toner may be used as either a one-component developer comprising the toner alone or a two-component developer in which the toner and a carrier are mixed. To be used for high-speed printers corresponding to recent improvement in information processing speed, the toner is preferably used as a two-component developer for an extended lifespan.

Image Forming Method

An image forming method in accordance with some embodiments of the present invention includes the processes of: charging a to-be-charged body; forming an electrostatic latent image on the to-be-charged body having been charged; developing the electrostatic latent image into a toner image with the above-described toner; transferring the toner image onto a transferor; cleaning a surface of the to-be-charged body with a cleaning member; and fixing the toner image. Preferably, the image forming method may further include the process of recycling the toner, further including the process of: collecting the toner removed from the surface of the to-be-charged body in the cleaning process; and supplying the toner collected in the collecting to the developing process.

The image forming method and an image forming apparatus for performing the image forming method are described in detail below.

FIG. 1 is a schematic view of a full-color image forming apparatus used for the image forming method in accordance with some embodiments of the present invention.

The image forming apparatus illustrated in FIG. 1 includes a drive roller 101A, a driven roller 101B, a photoconductor belt 102, a charger 103, a laser writing unit 104, developing units 105A to 105D respectively containing yellow, magenta, cyan, and black toners, a sheet tray 106, an intermediate transfer belt 107, a drive shaft roller 107A for driving the intermediate transfer belt 107, a pair of driven shaft rollers 107B for supporting the intermediate transfer belt 107, a cleaner 108, a fixing roller 109, a pressure roller 109A, a sheet ejection tray 110, and a sheet transfer roller 113.

The intermediate transfer belt 107 has flexibility. The intermediate transfer belt 107 is stretched taut with the drive shaft roller 107A and the pair of driven shaft rollers 107B and circulatingly conveyed clockwise in FIG. 1. A part of the surface of the intermediate transfer belt 107 stretched between the driven shaft rollers 107B is in contact with the photoconductor belt 102 on the outer periphery of the drive roller 101A from a horizontal direction.

In a regular full-color image forming operation, each time a toner image is formed on the photoconductor belt 102, the toner image is immediately transferred onto the intermediate transfer belt 107 to form a full-color composite toner image. The full-color composite toner image is transferred onto a transfer sheet that is fed from the sheet tray 106 by a sheet transfer roller 113. The transfer sheet having the composite toner image thereon is conveyed to between the fixing roller 109 and the pressure roller 109A in a fixing device. The transfer sheet on which the composite toner image has been fixed is ejected on the sheet ejection tray 110.

As the developing units 105A to 105D develop images with respective toners, the toner concentration in each developer contained in each developing unit is decreased. A decrease of toner concentration in the developer is detected by a toner concentration sensor. As a decrease of toner concentration is detected, toner supply devices connected to respective developing units start operation to supply toner and increase toner concentration. In a case in which the developing unit is equipped with a developer ejection mechanism, a developer exclusive for trickle development in which the toner is mixed with a carrier may be supplied in place of the toner.

According to another embodiment, toner images may be directly transferred from a transfer drum onto a recording medium without being transferred onto an intermediate transfer belt in a superimposed manner.

Figure 2:
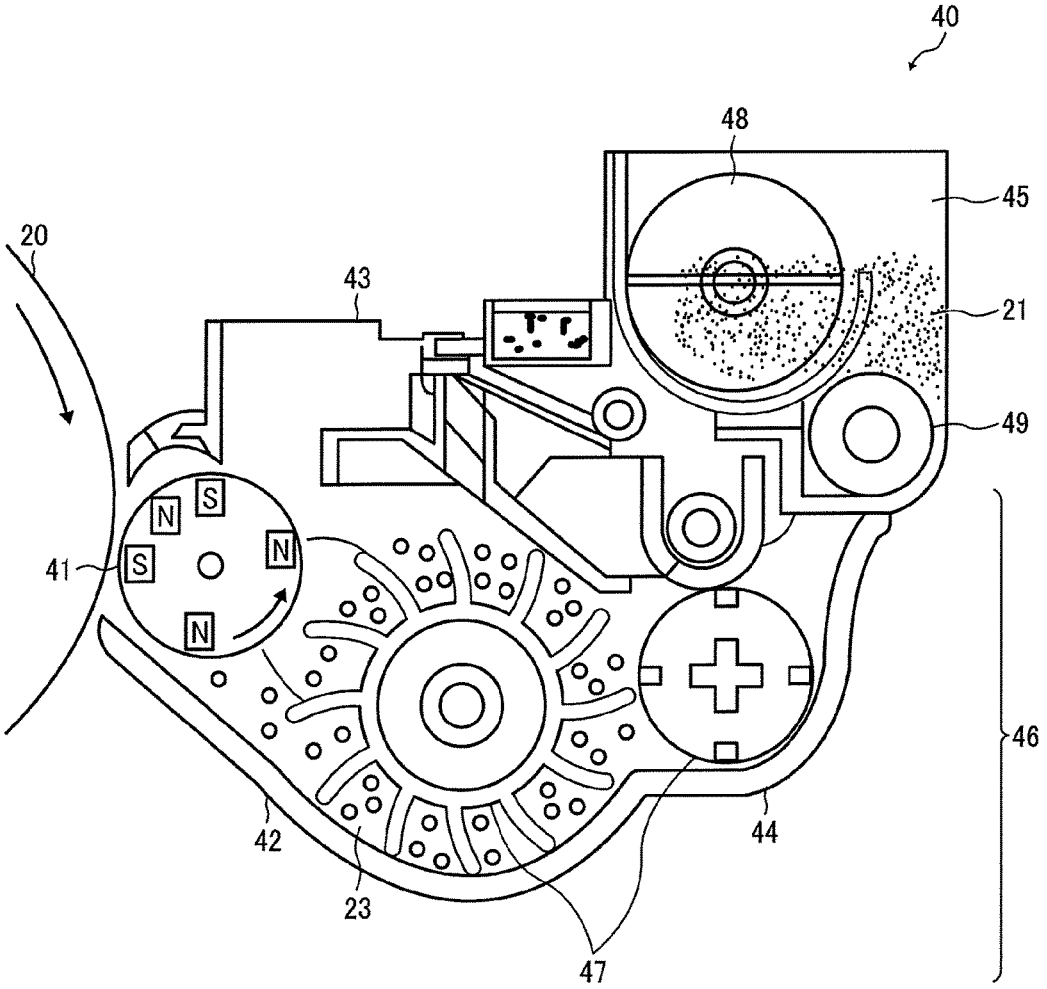
FIG. 2 is a schematic view of a developing device in accordance with some embodiments of the present invention.

FIG. 2 is a schematic view of a developing device 40 in accordance with some embodiments of the present invention.

Referring to FIG. 2, the developing device 40 is disposed facing a photoconductor 20 serving as a latent image bearer. The developing device includes a developing sleeve 41 serving as a developer bearer, a developer housing 42, a doctor blade 43 serving as a regulator, and a support casing 44.

The support casing 44 has an opening on the photoconductor 20 side. A toner hopper 45, serving as a toner container, containing a toner 21 is joined to the support casing 44. A developer container 46 contains a developer comprising the toner 21 and a carrier 23, and is disposed adjacent to the toner hopper 45. Inside the developer container 46, a developer stirring mechanism 47 is disposed configured to stir the toner 21 and the carrier 23 to give triboelectric/separation charge to the toner 21.

Inside the toner hopper 45, a toner agitator 48 and a toner supply mechanism 49 are disposed. The toner agitator 48 is driven to rotate by a driver. The toner agitator 48 and the toner supply mechanism 49 feed the toner 21 contained in the toner hopper 45 toward the developer container 46 by agitating the toner.

The developing sleeve 41 is disposed within a space formed between the photoconductor 20 and the toner hopper 45. The developing sleeve 41 is driven to rotate in a direction indicated by arrow in FIG. 2. Inside the developing sleeve 41, magnets, serving as magnetic field generators, having invariance relative positions to the developing device are disposed, for forming a magnetic brush of the carrier 23.

The doctor blade 43 is integrally installed to one side of the developer housing 42 opposite to a side to which the support casing 44 is installed. An edge of the doctor blade 43 is disposed facing the outer circumferential surface of the developing sleeve 41 forming a constant gap therebetween.

With the above configuration, the toner 21 is fed from the toner hopper 45 to the developer container 46 by the toner agitator 48 and the toner supply mechanism 49. The toner 21 is then stirred by the developer stirring mechanism 47 to be given a desired triboelectric/separation charge. The charged toner 21 is carried on the developing sleeve 41 together with the carrier 23 and conveyed to a position where the developing sleeve 41 faces the outer circumferential surface of the photoconductor 20. The toner 21 is electrostatically bound to an electrostatic latent image formed on the photoconductor 20, thus forming a toner image on the photoconductor 20.

Figure 3:
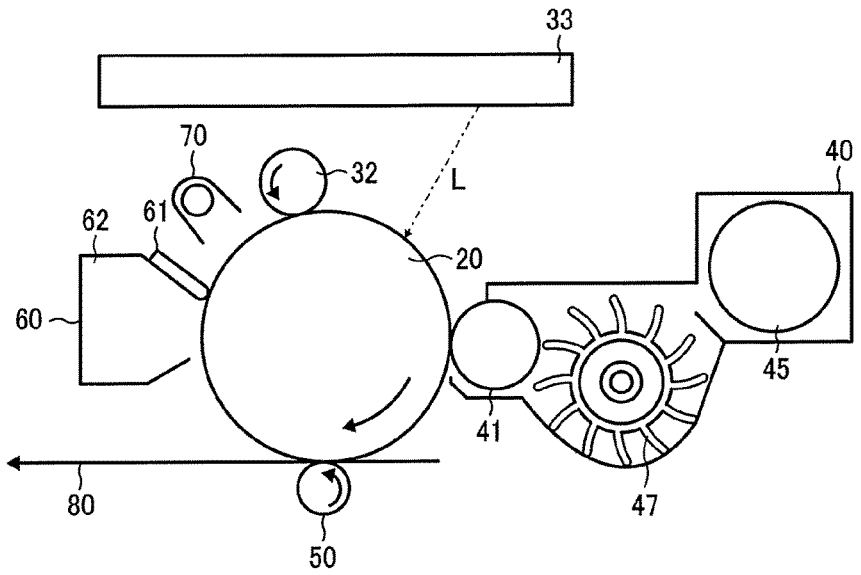
FIG. 3 is a schematic view of an image forming apparatus including the developing device illustrated in FIG. 2.

FIG. 3 is a schematic view of an image forming apparatus including the developing device illustrated in FIG. 2. The image forming apparatus illustrated in FIG. 3 includes a charger 32, an irradiator 33, the developing device 40, a transfer device 50, a cleaner 60, and a neutralization lamp 70, each of which being disposed around the photoconductor 20. The charger 32 and the photoconductor 20 are out of contact with each other forming a gap having a distance of about 0.2 mm therebetween. The charger 32 charges the photoconductor 20 by an electric field in which an alternating current component is superimposed on a direct current component by a voltage applicator, thus effectively reducing charging unevenness.

A series of image forming processes can be explained based on a negative-positive developing mechanism. The photoconductor 20, represented by an organic photoconductor (OPC) having an organic photoconductive layer, is neutralized by the neutralization lamp 70, uniformly negatively charged by the charger 32 (e.g., charging roller), and irradiated with laser light L emitted from the irradiator 33, so that a latent image is formed thereon. In this case, the absolute value of the potential of the irradiated potion is lower than that of the non-irradiated portion.

The laser light L is emitted from a semiconductor laser and reflected by a polygon mirror that is rotating at a high speed, thus scanning the surface of the photoconductor 20 in its rotational axis direction. The latent image thus formed is developed into a toner image with a developer comprising the toner and a carrier having been supplied onto the developing sleeve 41 (serving as a developer bearer) disposed in the developing device 40. In developing the latent image, a voltage applicator applies a developing bias to between the developing sleeve 41 and the irradiated and non-irradiated portions on the photoconductor 20. The developing bias is a direct current voltage of an appropriate magnitude or that on which an alternating current is superimposed.

At the same time, a transfer medium 80 (e.g., paper sheet) is fed from a sheet feeding mechanism to between the photoconductor 20 and the transfer device 50 by a registration roller pair in synchronization with an entry of a leading edge of an image thereto, thus transferring the toner image onto the transfer medium 80. At this time, the transfer device 50 is preferably applied with a transfer bias having the opposite polarity to the toner charge. The transfer medium 80 is thereafter separated from the photoconductor 20, thus obtaining a transfer image.

Residual toner particles remaining on the photoconductor 20 are collected by a cleaning blade 61 into a toner collection chamber 62 disposed in the cleaner 60.

The collected toner particles may be conveyed to the developer container 46 and/or the toner hopper 45 by a toner recycler to be reused.

The image forming apparatus includes a plurality of the above developing units. A plurality of toner images may be sequentially transferred onto the transfer medium and thereafter fed to a fixing device to be fixed on the transfer medium by heat. Alternatively, a plurality of toner images may be once transferred onto an intermediate transfer medium and then transferred onto the transfer medium all at once and fixed thereon.

Figure 4:
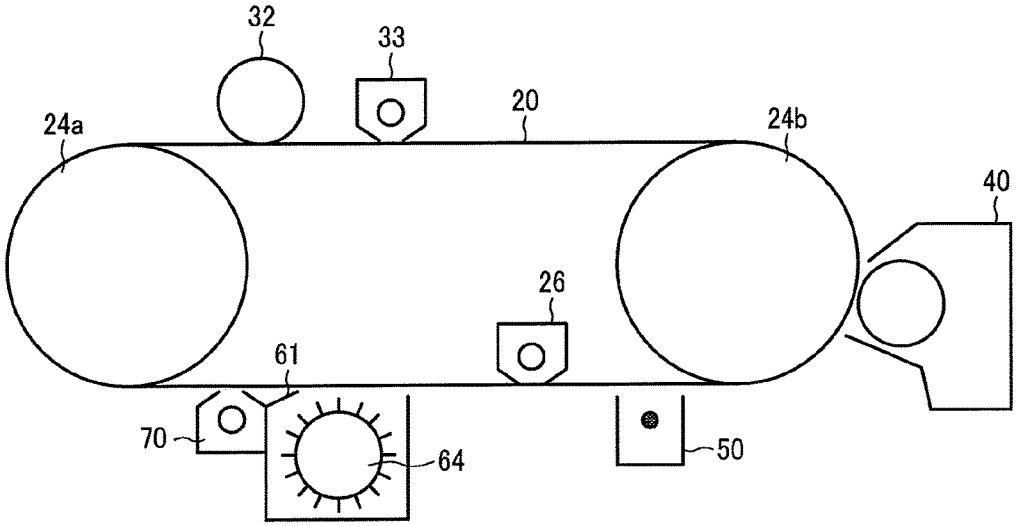
FIG. 4 is a schematic view of another image forming apparatus in accordance with some embodiments of the present invention.

FIG. 4 is a schematic view of another image forming apparatus in accordance with some embodiments of the present invention. In this image forming apparatus, a photoconductor 20 comprises a conductive substrate and a photosensitive layer disposed thereon. The photoconductor 20 is driven by drive rollers 24*a* and 24*b*, charged by a charger 32, and irradiated with light emitted from an irradiator 33, so that a latent image is formed thereon. The latent image is developed by a developing device 40 and transferred by a transfer device 50. The photoconductor 20 is irradiated with light emitted from a pre-cleaning irradiator 26 before being cleaned, cleaned by a brush cleaner 64 and a cleaning blade 61, and neutralized by a neutralization lamp 70. These operations are repeatedly performed. In the embodiment illustrated in FIG. 4, the photoconductor 20 is irradiated with light from the substrate side before being cleaned. In this case, the substrate is light-transmissive.

EXAMPLES

Further understanding can be obtained by reference to certain specific examples which are provided herein for the purpose of illustration only and are not intended to be limiting. In the descriptions in the following examples, the numbers represent mass ratios in parts, unless otherwise specified. Some of the Example presented below are prophetic and contain estimated results.

Measurement of Volume Average Particle Diameter of Toner

Volume average particle diameter of a toner was measured by using an instrument COULTER COUNTER MULTISIZER III in the following manner. First, the toner was dispersed in an electrolytic solution containing a surfactant by an ultrasonic disperser for one minute. Next, 50,000 toner particles dispersed therein were subjected to a measurement of volume average particle diameter by the above instrument.

Measurement of Average Circularity

First, 0.1 to 0.5 ml of an alkylbenzene sulfonate, serving as a dispersant, was added to 100 to 150 ml of water from which solid impurities had been removed, and further 0.1 to 0.5 g of a sample (toner) was added thereto. The resulting suspension liquid in which the sample was dispersed was subjected to a dispersion treatment by an ultrasonic disperser for 1 to 3 minutes. The resulting dispersion liquid containing 3,000 to 10,000 toner particles/μl was subjected to a measurement of toner shape by a flow particle image analyzer FPIA-3000 (available from Sysmex Corporation).

Measurement of Dispersion Diameter of Wax in Toner

First, a toner was embedded in an epoxy resin and a cross-section thereof was cut out with a microtome. The cross-section of the toner was dyed with ruthenium and observed with an Ultra-high Resolution Scanning Electron Microscope (cold) SU8230 (available from Hitachi High- Technologies Corporation) at a magnification of 5,000 times. The reflected electron image was input in an image analysis software program A-ZOU KUN (available from Asahi Kasei Engineering Corporation) at a scale unit of μm. The ruthenium-dyed particle portions were subjected to an analysis (i.e., binarization) to calculate the circle-equivalent average diameter.

Measurement of Endothermic Quantity of Endothermic Peak

A sample (toner) in an amount of from 4.8 to 5.2 mg was weighed in an aluminum pan and heated from 0° C. to 150° C. at a temperature rising rate of 10° C/min in a differential scanning calorimeter (DSC210 available from Seiko Instruments Inc.). The endothermic quantity of the highest endothermic peak was determined as that of the endothermic peak of the toner.

GC-MS Measurement of Toner

A GC-MS measurement was performed by a gas chromatography mass spectrometer (GCMS-QP2010 available from Shimadzu Corporation), a heating device (PY2010 available from Frontier Laboratories Ltd.), and columns (Ultra ALLOY-5, UA5-30M-0, 25F). A very small amount of a sample (toner) was put in a sample cup, and 1 to 2 μl of a 10% methanol solution of tetramethylammonium hydroxide (available from Tokyo Chemical Industry Co., Ltd.), serving as a reaction reagent, was dropped therein. In the measurement, the pyrolysis temperature was 300° C., the column temperature was raised from 50° C. (maintained 1 minute) to 320° C. (maintained 7 minutes) at a rate of 10° C./min, the carrier gas flow rate was 53.6 kPa (constant), the column flow rate was 1.0 ml/min, the ionization (EI) method was employed, the mass range (m/z) was from 29 to 700, and the injection mode was Split (1:100). The detected peaks were specified using a data analysis software program (GCMSsolution available from Shimadzu Corporation).

Resin Preparation Example

Preparation of Polyester Resin 1

A 5-liter autoclave equipped with a distillation tower was charged with 4,000 g of monomers comprising aromatic diol components comprising 50% by mol of polyoxypropylene (2.2)-2,2-bis(4-hydroxyphenyl)propane (hereinafter "BPA-PO") and 50% by mol of ethylene glycol and carboxylic acid components comprising 40% by mol of adipic acid, 20% by mol of terephthalic acid, 20% by mol of isophthalic acid, and 20% by mol of trimellitic acid. The monomers were subjected to an esterification reaction at 170° C. to 260° C. at normal pressure in the absence of catalyst. Antimony trioxide in an amount of 400 ppm based on all the carboxylic acid components was thereafter added to the reaction system, and a polycondensation was conducted at 250° C. under vacuum (3 Torr) while removing glycol out of the reaction system. Thus, a polyester resin 1 was prepared. The cross-linking reaction was conducted until the stirring torque became 10 kg·cm (100 ppm). The reaction was terminated by releasing the reaction system from the reduced pressure state.

Properties of the polyester resin 1 are shown in Table 1.

TABLE 1

Composition and Properties of Polyester Resin 1

| | | |
|---|---|---|
| Alcohol Components | *BPA-PO (mol %) | 50 |
| | Ethylene glycol (mol %) | 50 |
| Carboxylic Acid Components | Adipic acid (mol %) | 40 |
| | Terephthalic acid (mol %) | 20 |
| | Isophthalic acid (mol %) | 20 |
| | Trimellitic acid (mol %) | 20 |

TABLE 1-continued

Composition and Properties of Polyester Resin 1

| | | |
|---|---|---|
| Properties of Polyester Resin | Softening point (° C.) | 126 |
| | Glass transition temp. (° C.) | 62.3 |
| | Tangent loss peak temp. (° C.) | 105 |
| | Tangent loss value | 18 |
| | Acid value (mg/KOH/g) | 10.5 |
| | Hydroxyl value (mg/KOH/g) | 32.2 |
| | Molecular weight Mw | 8660 |
| | Molecular weight Mn | 2630 |
| | Mw/Mn | 3.3 |

*BPA-PO: Polyoxypropylene(2.2)-2,2-bis(4-hydroxyphenyl)propane

Monoester Wax Preparation Examples

Preparation of Monoester Wax 1

A 1-liter four-neck flask equipped with a thermometer, a nitrogen introducing tube, a stirrer, and a cooling tube was charged with fatty acid components comprising 50 parts by mass of cerotic acid and 50 parts by mass of palmitic acid and alcohol components comprising 100 parts by mass of ceryl alcohol. The total amount of the fatty acid components and the alcohol components was 500 g. These components were subjected to a reaction at 220° C. at normal pressure for 15 hours or more under nitrogen gas flow while distilling reaction products away. Thus, a monoester wax 1 was prepared. The melting point of the monoester wax 1 is shown in Table 2.

Preparation of Monoester Wax 2

A 1-liter four-neck flask equipped with a thermometer, a nitrogen introducing tube, a stirrer, and a cooling tube was charged with fatty acid components comprising 10 parts by mass of cerotic acid and 90 parts by mass of palmitic acid and alcohol components comprising 100 parts by mass of ceryl alcohol. The total amount of the fatty acid components and the alcohol components was 500 g. These components were subjected to a reaction at 220° C. and normal pressure for 15 hours or more under nitrogen gas flow while distilling reaction products away. Thus, a monoester wax 2 was prepared. The melting point of the monoester wax 2 is shown in Table 2.

TABLE 2

| | | Monoester Wax No. | |
|---|---|---|---|
| | | 1 | 2 |
| Fatty Acid Components | Cerotic acid (parts by mass) | 50 | 10 |
| | Palmitic acid (parts by mass) | 50 | 90 |
| Alcohol Components | Ceryl alcohol (parts by mass) | 100 | 100 |
| Property of Monoester Wax | Melting point (° C.) | 71 | 64 |

Wax Dispersing Agent Preparation Examples

Preparation of Wax Dispersing Agent 1

A 5-liter autoclave equipped with a distillation tower was charged with 4,000 g of polyester resin raw material monomers comprising 45% by mol of polyoxypropylene(2.2)-2,2-bis(4-hydroxyphenyl)propane (hereinafter "BPA-PO") represented by the formula (1) and 30% by mol of sebacic acid. Dibutyl tin oxide in an amount of 5 g was added to the reaction system as an esterification catalyst, and a condensation polymerization was conducted at 230° C. for 6 hours under nitrogen atmosphere. The reaction system was thereafter cooled to 160° C. A mixture of addition polymerization resin raw material monomers comprising 15% by mol of styrene and 10% by mol of acrylic acid with 25 g of di-tert-butyl peroxide as a polymerization initiator was dropped in the autoclave over a period of 1 hour while stirring the reaction system at 160° C. The temperature of the reaction system was maintained at 160° C. for 1 hour to conduct an addition polymerization reaction and thereafter raised to 200° C. to conduct a condensation polymerization.

Preparation of Wax Dispersing Agent 2

A 5-liter autoclave equipped with a distillation tower was charged with 4,000 g of polyester resin raw material monomers comprising 45% by mol of polyoxypropylene(2.2)-2,2-bis(4-hydroxyphenyl)propane (hereinafter "BPA-PO"), 15% by mol of sebacic acid, and 15% by mol of terephthalic acid. Dibutyl tin oxide in an amount of 5 g was added to the reaction system as an esterification catalyst, and a condensation polymerization was conducted at 230° C. for 6 hours under nitrogen atmosphere. The reaction system was thereafter cooled to 160° C. A mixture of addition polymerization resin raw material monomers comprising 15% by mol of styrene and 10% by mol of acrylic acid with 25 g of di-tert-butyl peroxide as a polymerization initiator was dropped in the autoclave over a period of 1 hour while stirring the reaction system at 160° C. The temperature of the reaction system was maintained at 160° C. for 1 hour to conduct an addition polymerization reaction and thereafter raised to 200° C. to conduct a condensation polymerization.

Preparation of Wax Dispersing Agent 3

A 5-liter autoclave equipped with a distillation tower was charged with 4,000 g of polyester resin raw material monomers comprising 45% by mol of 1,10-decanediol and 30% by mol of sebacic acid. Dibutyl tin oxide in an amount of 5 g was added to the reaction system as an esterification catalyst, and a condensation polymerization was conducted at 230° C. for 6 hours under nitrogen atmosphere. The reaction system was thereafter cooled to 160° C. A mixture of addition polymerization resin raw material monomers comprising 15% by mol of styrene and 10% by mol of acrylic acid with 25 g of di-tert-butyl peroxide as a polymerization initiator was dropped in the autoclave over a period of 1 hour while stirring the reaction system at 160° C. The temperature of the reaction system was maintained at 160° C. for 1 hour to conduct an addition polymerization reaction and thereafter raised to 200° C. to conduct a condensation polymerization.

Preparation of Wax Dispersing Agent 4

A 5-liter autoclave equipped with a distillation tower was charged with 4,000 g of polyester resin raw material monomers comprising 22.5% by mol of polyoxypropylene(2.2)-2,2-bis(4-hydroxyphenyl)propane (hereinafter "BPA-PO"), 22.5% by mol of 1,10-decanediol, and 30% by mol of adipic acid. Dibutyl tin oxide in an amount of 5 g was added to the reaction system as an esterification catalyst, and a condensation polymerization was conducted at 230° C. for 6 hours under nitrogen atmosphere. The reaction system was thereafter cooled to 160° C. A mixture of addition polymerization resin raw material monomers comprising 15% by mol of styrene and 10% by mol of acrylic acid with 25 g of di-tert-butyl peroxide as a polymerization initiator was dropped in the autoclave over a period of 1 hour while stirring the reaction system at 160° C. The temperature of the reaction system was maintained at 160° C. for 1 hour to conduct an addition polymerization reaction and thereafter raised to 200° C. to conduct a condensation polymerization.

Preparation of Wax Dispersing Agent 5

A 5-liter autoclave equipped with a distillation tower was charged with 4,000 g of polyester resin raw material monomers comprising 22.5% by mol of polyoxypropylene(2.2)-2,2-bis(4-hydroxyphenyl)propane (hereinafter "BPA-PO"), 22.5% by mol of 1,10-decanediol, and 30% by mol of eicosanedioic acid. Dibutyl tin oxide in an amount of 5 g was added to the reaction system as an esterification catalyst, and a condensation polymerization was conducted at 230° C. for 6 hours under nitrogen atmosphere. The reaction system was thereafter cooled to 160° C. A mixture of addition polymerization resin raw material monomers comprising 15% by mol of styrene and 10% by mol of acrylic acid with 25 g of di-tert-butyl peroxide as a polymerization initiator was dropped in the autoclave over a period of 1 hour while stirring the reaction system at 160° C. The temperature of the reaction system was maintained at 160° C. for 1 hour to conduct an addition polymerization reaction and thereafter raised to 200° C. to conduct a condensation polymerization.

Toner Preparation Examples

Preparation of Toners 1 to 10

Toner raw materials described in Table 3 were preliminarily mixed by a HENSCHEL MIXER (FM20B available from NIPPON COKE & ENGINEERING CO., LTD.) and melt-kneaded by a single-shaft kneader (Buss Ko-Kneader) at 100° C. to 130° C. The kneaded product was cooled to room temperature and pulverized into coarse particles having a diameter of from 200 to 300 μm by a ROTOPLEX. The coarse particles were further pulverized into fine particles having a weight average particle diameter of 6.5 ±0.3 μm by a COUNTER JET MILL (100AFG available from Hosokawa Micron Corporation) while appropriately adjusting the pulverization air pressure. The fine particles were classified by size using an air classifier (EJ-LABO available from MATSUBO Corporation) while appropriately adjusting the opening of the louver such that the weight average particle diameter became 7±0.2 μm and the ratio of weight average particle diameter to number average particle diameter became 1.25 or less. Thus, mother toners 1 to 10 were prepared.

Next, 100 parts of each mother toner was mixed with additives (comprising 1.0 parts of HDK-2000 and 1.0 part of HO5TD both available from Clariant) by a HENSCHEL MIXER. Thus, toners 1 to 10 were prepared.

Properties (i.e., volume average particle diameter, average circularity, dispersion diameter of wax, melting point of wax, GC-MS results, and endothermic quantity of endothermic peak) of the toners 1 to 10 are shown in Tables 4-1 and 4-2.

TABLE 3

| Example | Toner | Binder Resin | | Release Agent | | Wax Dispersing Agent | | Pigment | |
|---|---|---|---|---|---|---|---|---|---|
| No. | No. | Type | parts | Type | parts | Type | parts | Type | parts |
| Example 1 | 1 | Polyester resin 1 | 94 | Monoester wax 1 | 6 | Wax dispersing agent 1 | 6 | Carbon black | 10 |
| Example 2 | 2 | Polyester resin 1 | 94 | Monoester wax 1 | 6 | Wax dispersing agent 2 | 6 | Carbon black | 10 |

TABLE 3-continued

| Example No. | Toner No. | Binder Resin Type | Binder Resin parts | Release Agent Type | Release Agent parts | Wax Dispersing Agent Type | Wax Dispersing Agent parts | Pigment Type | Pigment parts |
|---|---|---|---|---|---|---|---|---|---|
| Example 3 | 4 | Polyester resin 1 | 94 | Monoester wax 2 | 6 | Wax dispersing agent 1 | 6 | Carbon black | 10 |
| Example 4 | 5 | Polyester resin 1 | 94 | Monoester wax 1 | 6 | Wax dispersing agent 1 | 6 | Phthalocyanine blue | 7 |
| Example 5 | 6 | Polyester resin 1 | 94 | *Carnauba wax | 6 | Wax dispersing agent 1 | 6 | Carbon black | 10 |
| Comparative Example 1 | 7 | Polyester resin 1 | 94 | Monoester wax 1 | 6 | — | — | Carbon black | 10 |
| Comparative Example 2 | 8 | Polyester resin 1 | 94 | Monoester wax 1 | 6 | Wax dispersing agent 3 | 6 | Carbon black | 10 |
| Comparative Example 3 | 8 | Polyester resin 1 | 94 | Monoester wax 1 | 6 | Wax dispersing agent 4 | 6 | Carbon black | 10 |
| Comparative Example 4 | 9 | Polyester resin 1 | 94 | Monoester wax 1 | 6 | Wax dispersing agent 5 | 6 | Carbon black | 10 |
| Comparative Example 5 | 10 | Polyester resin 1 | 94 | **Microcrystalline wax | 6 | Wax dispersing agent 1 | 6 | Carbon black | 10 |

*Carnauba Wax: WA-03 available from TOAKASEI CO., LTD.

**Microcrystalline Wax: Hi-Mic-1045 available from Nippon Seiro Co., Ltd.

TABLE 4-1

| Example No. | Toner No. | Volume Average Particle Diameter (μm) | Average Circularity | Dispersion Diameter of Wax (μm) | Melting Point of Wax (° C.) | Endothermic Quantity (J/g) |
|---|---|---|---|---|---|---|
| Example 1 | 1 | 7.0 | 0.94 | 0.4 | 73 | 5.5 |
| Example 2 | 2 | 7.0 | 0.94 | 0.4 | 73 | 5.5 |
| Example 3 | 4 | 6.8 | 0.93 | 0.4 | 65 | 5.5 |
| Example 4 | 5 | 7.0 | 0.94 | 0.3 | 72 | 5.5 |
| Example 5 | 6 | 7.1 | 0.93 | 0.5 | 79 | 5.0 |
| Comparative Example 1 | 7 | 7.2 | 0.92 | 1.5 | 71 | 3.0 |
| Comparative Example 2 | 8 | 7.2 | 0.94 | 1.1 | 73 | 3.5 |
| Comparative Example 3 | 8 | 7.1 | 0.94 | 0.8 | 72 | 4.0 |
| Comparative Example 4 | 9 | 7.1 | 0.94 | 0.8 | 72 | 4.0 |
| Comparative Example 5 | 10 | 7.1 | 0.93 | 0.7 | 71 | 4.5 |

TABLE 4-2

| Example No. | GC-MS-Measurement: Derived from Wax, Dispersing Agent: C9-C14 Dicarboxylic Acid Components | Derived from Wax, Dispersing Agent: C9-C14 Aliphatic Diol Components | Derived from Wax: C14-C30 Straight-chain Saturated Monocarboxylic Acid Components | Derived from Wax: C14-C30 Straight-chain Saturated Monovalent Alcohol Components |
|---|---|---|---|---|
| Example 1 | Yes | No (Aromatic) | Yes | Yes |
| Example 2 | Yes | No (Aromatic) | Yes | Yes |
| Example 3 | Yes | No (Aromatic) | Yes | Yes |

TABLE 4-2-continued

| | GC-MS-Measurement | | | |
|---|---|---|---|---|
| | Derived from Wax | | Derived from Wax | |
| | Dispersing Agent | | C14-C30 | C14-C30 |
| Example No. | C9-C14 Dicarboxylic Acid Components | C9-C14 Aliphatic Diol Components | Straight-chain Saturated Monocarboxylic Acid Components | Straight-chain Saturated Monovalent Alcohol Components |
| Example 4 | Yes | No (Aromatic) | Yes | Yes |
| Example 5 | Yes | No (Aromatic) | Yes | Yes |
| Comparative Example 1 | No | No | Yes | Yes |
| Comparative Example 2 | Yes | Yes | Yes | Yes |
| Comparative Example 3 | No | Yes | Yes | Yes |
| Comparative Example 4 | No | Yes | Yes | Yes |
| Comparative Example 5 | Yes | No (Aromatic) | No | No |

Two-component Developer Preparation Example

Preparation of Carrier A

Silicone resin (Organo straight silicone): 100 parts

Toluene: 100 parts

γ-(2-Aminoethyl) aminopropyl trimethoxysilane: 5 parts

Carbon black: 10 parts

The above materials were dispersed by a homomixer for 20 minutes to prepare a coating layer forming liquid. Manganese (Mn) ferrite particles having a weight average particle diameter of 35 μm, serving as core materials, were coated with the coating layer forming liquid using a fluidized bed coating device while controlling the temperature inside the fluidized bed to 70° C. The dried coating layer on the surface of the core material had an average film thickness of 0.20 μm.

The core material having the coating layer was calcined in an electric furnace at 180° C. for 2 hours. Thus, a carrier A was prepared.

Preparation of Two-component Developer

The toner was uniformly mixed with the carrier A by a TURBULA MIXER (available from Willy A. Bachofen (WAB)) at a revolution of 48 rpm for 5 minutes to be charged. Thus, a two-component developer was prepared. The mixing ratio of the toner to the carrier was 4% by mass, which was equal to the initial toner concentration in the developer in the test machine.

Evaluations

The two-component developers using the toners 1 to 10 were subjected to the following evaluations.

Evaluation of Low-temperature Fixability

Each developer was set in a modified digital full-color multifunction peripheral IMAGIO NEO C600 (available from Ricoh Co., Ltd.) having a linear velocity of 280 mm/sec. A 4-cm square solid image having a toner deposition amount of 0.85 mg/cm$^2$ was formed on multiples sheets of PPC paper TYPE 6000 (70 W) (available from Ricoh Co., Ltd.) while setting the nip width to 10 mm and varying the temperature of the fixing roller. Whether cold offset had occurred or not was determined by visual observation of the image. The lower-limit fixable temperature was defined as the lower-limit temperature at which cold offset did not occur. Low-temperature fixability was evaluated by the lower-limit fixable temperature based on the following criteria.

Evaluation Criteria

A: The lower-limit fixable temperature was lower than 140° C.

B: The lower-limit fixable temperature was 140° C. or higher and lower than 145° C.

C: The lower-limit fixable temperature was 145° C. or higher and lower than 150° C.

D: The lower-limit fixable temperature was 150° C. or higher.

Evaluation of Hot Offset Resistance

Each developer was set in a modified digital full-color multifunction peripheral IMAGIO NEO C600 (available from Ricoh Co., Ltd.) having a linear velocity of 280 mm/sec. A 4-cm square solid image having a toner deposition amount of 0.85 mg/cm$^2$ was formed on multiples sheets of PPC paper TYPE 6000 (70 W) (available from Ricoh Co., Ltd.) while setting the nip width to 10 mm and varying the temperature of the fixing roller. Whether hot offset had occurred or not was determined by visual observation of the image. The upper-limit fixable temperature was defined as the upper-limit temperature at which hot offset did not occur. Hot offset resistance was evaluated based by the upper-limit fixable temperature based on the following criteria.

Evaluation Criteria

A: The upper-limit fixable temperature was 185° C. or higher.

B: The upper-limit fixable temperature was 175° C. or higher and lower than 185° C.

C: The upper-limit fixable temperature was 170° C. or higher and lower than 175° C.

D: The upper-limit fixable temperature was lower than 170° C.

Evaluation of Heat-resistant Storage Stability

Heat-resistant storage stability was evaluated based on penetration measured by a penetration tester (available from YASUDA SEIKI SEISAKUSHO, LTD.) in the following manner.

First, 10 g of each toner was put in a 30-ml glass container (screw vial) in an environment having a temperature of from 20° C. to 25° C. and a humidity of 40% RH to 60% RH and the container was sealed with a lid. The glass container containing the toner was subjected to a tapping for 100 times and thereafter left to stand in a thermostatic chamber having a temperature of 50° C. for 24 hours. Penetration of the toner was measured by the above penetration tester. Heat-resistant storage stability was evaluated based on the following criteria.

The greater the penetration, the more excellent the heat-resistant storage stability.

Evaluation Criteria

A: Penetration was 30 mm or greater.

B: Penetration was 25 mm or greater and less than 30 mm.

C: Penetration was 20 mm or greater and less than 25 mm.

D: Penetration was less than 20 mm.

Evaluation of Filming Resistance 1

Each developer was set in a modified digital full-color multifunction peripheral IMAGIO NEO C600 (available from Ricoh Co., Ltd.) having a linear velocity of 280 mm/sec. A running test was performed in which an image having an image occupancy of 7% was continuously formed on multiple sheets of PPC paper TYPE 6000 (70 W) (available from Ricoh Co., Ltd.). After the 20,000th, 50,000th, or 100,000th sheet was output, the photoconductor was observed to determine whether filming and the accompanied abnormal image (i.e., density-uneven halftone image) had occurred or not. Filming is more likely to occur as the number of output sheets is increased.

Evaluation Criteria

A: Filming/abnormal image did not occur even after outputting 100,000-149,999 sheets.

B: Filming/abnormal image did not occur even after outputting 100,000 sheets.

C: Filming/abnormal image occurred after outputting 50,000-99,999 sheets.

D: Filming/abnormal image occurred after outputting 10,000-49,999 sheets.

Evaluation of Filming Resistance 2

Each developer was set in a modified digital full-color multifunction peripheral RICOH MP6055 (available from Ricoh Co., Ltd.) having a linear velocity of 280 mm/sec. A running test was performed in which an image having an image occupancy of 7% was continuously formed on multiple sheets of paper ASKUL SUPER WHITE PLUS. After the 20,000th, 50,000th, or 100,000th sheet was output, the photoconductor was observed to determine whether filming and the accompanied abnormal image (i.e., density-uneven halftone image) had occurred or not. Filming is more likely to occur as the number of output sheets is increased.

Evaluation Criteria

B: Filming/abnormal image did not occur even after outputting 100,000 sheets.

C: Filming/abnormal image occurred after outputting 50,000-99,999 sheets.

D: Filming/abnormal image occurred after outputting 10,000-49,999 sheets.

Evaluation of Developer Property 1

Each developer was set in a modified digital full-color multifunction peripheral IMAGIO NEO C600 (available from Ricoh Co., Ltd.) having a linear velocity of 280 mm/sec. A running test in which an image having an image occupancy of 5% was continuously formed on multiple sheets of PPC paper TYPE 6000 (70 W) (available from Ricoh Co., Ltd.) was performed. The charge amounts of the carrier at an initial stage and after the 100,000th sheet was output were measured to calculate a decrease in charge amount before and after the running test.

An initial charge amount (Q1) of the carrier was measured from a mixture of 96 parts by mass of the toner and 4 parts by mass of the carrier A which had been triboelectrically charged using a blow off device TB-200 (product of Toshiba Chemical Corp.). A charge amount (Q2) after the running test was measured from the developer used in the running test from which the toner had been removed using the blow off device.

Evaluation Criteria

A: $Q1-Q2 \leq 5$

B: $5 < Q1-Q2 \leq 10$

C: $10 < Q1-Q2 \leq 20$

D: $20 < Q1-Q2$

Evaluation of Developer Property 2

Each developer was set in a modified digital full-color multifunction peripheral RICOH MP6055 (available from Ricoh Co., Ltd.) having a linear velocity of 280 mm/sec. A running test in which an image having an image occupancy of 5% was continuously formed on multiple sheets of paper ASKUL SUPER WHITE PLUS was performed. The charge amounts of the carrier at an initial stage and after the 100,000th sheet was output were measured to calculate a decrease in charge amount before and after the running test.

An initial charge amount (Q1) of the carrier was measured from a mixture of 96 parts by mass of the toner and 4 parts by mass of the carrier A which had been triboelectrically charged using a blow off device TB-200 (product of Toshiba Chemical Corp.). A charge amount (Q2) after the running test was measured from the developer used in the running test from which the toner had been removed using the blow off device.

Evaluation Criteria

A: $Q1-Q2 \leq 5$

B: $5 < Q1-Q2 \leq 10$

C: $10 < Q1-Q2 \leq 20$

D: $20 < Q1-Q2$

The evaluation results are shown in Table 5.

TABLE 5

| Example No. | Toner No. | Low-temperature Fixability | Hot Offset Resistance | Heat-resistant Storage Stability | Filming Resistance 1 | Filming Resistance 2 | Developer Property 1 | Developer Property 2 |
|---|---|---|---|---|---|---|---|---|
| Example 1 | 1 | B | B | B | A | B | A | B |
| Example 2 | 2 | C | A | A | B | B | B | B |
| Example 3 | 4 | A | C | B | B | B | B | B |
| Example 4 | 5 | B | B | B | B | B | B | B |
| Example 5 | 6 | C | A | B | C | C | B | C |
| Comparative Example 1 | 7 | C | B | D | Stopped at less than 10,000 sheets | Stopped at less than 10,000 sheets | Stopped at less than 10,000 sheets | Stopped at less than 10,000 sheets |

TABLE 5-continued

| Example No. | Toner No. | Low-temperature Fixability | Hot Offset Resistance | Heat-resistant Storage Stability | Filming Resistance 1 | Filming Resistance 2 | Developer Property 1 | Developer Property 2 |
|---|---|---|---|---|---|---|---|---|
| Comparative Example 2 | 8 | A | B | D | D | Stopped at less than 10,000 sheets | D | Stopped at less than 10,000 sheets |
| Comparative Example 3 | 8 | B | C | D | D | D | D | D |
| Comparative Example 4 | 9 | C | B | C | D | D | D | D |
| Comparative Example 5 | 10 | B | B | C | C | D | D | D |

It is clear from Table 5 that the developers of Examples have excellent low-temperature fixability and a good combination of high hot offset resistance, high durability, and heat-resistant storage stability, and are capable of forming high-quality image for an extended period of time.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A toner comprising:

a binder resin comprising a polyester resin;

a release agent comprising an ester wax which comprises a monoester wax comprising a straight-chain saturated monocarboxylic acid having 14 to 30 carbon atoms and a straight-chain saturated monovalent alcohol having 14 to 30 carbon atoms, wherein the ester wax has a dispersion diameter of from 0.1 to 0.5 μm in a cross-section of the toner dyed with ruthenium; and a wax dispersing agent comprising a hybrid resin, the hybrid resin comprising:

a condensation polymerization resin unit comprising a condensation polymerization product of an aromatic alcohol component and a carboxylic acid component, the carboxylic acid component comprising an aliphatic dicarboxylic acid having 9 to 14 carbon atoms; and an addition polymerization resin unit comprising an addition polymerization product of a styrene monomer, wherein the toner has an endothermic peak having an endothermic quantity of from 3 to 10 J/g and said endothermic peak arises from the ester wax.

2. The toner of claim 1, wherein the toner has an average circularity of 0.95 or less.

3. The toner of claim 1, wherein the aromatic alcohol component is represented by the following formula (1)

Formula (1)

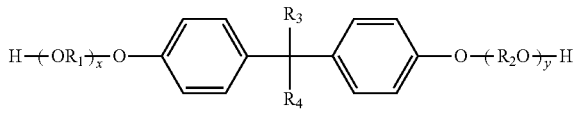

wherein each of R1 and R2 independently represents an alkylene group having 2 to 4 carbon atoms, each of R3 and R4 independently represents a hydrogen atom, a straight-chain or branched alkyl group having 1 to 6 carbon atoms, and each of x and y independently represents a positive integer where the sum of x and y ranging from 1 to 16.

4. The toner of claim 1, wherein alcohol components in the condensation polymerization resin unit consists essentially of the aromatic alcohol component.

5. An image forming method comprising:

charging a photoconductor;

forming an electrostatic latent image on the photoconductor having been charged;

developing the electrostatic latent image into a toner image with the toner of claim 1;

transferring the toner image onto a transferor;

cleaning a surface of the photoconductor with a cleaning member; and fixing the toner image.

6. The image forming method of claim 5, further comprising:

recycling the toner including:

collecting the toner removed from the surface of the photoconductor in the cleaning; and supplying the toner collected in the collecting to the developing.

7. A toner comprising:

a binder resin comprising a polyester resin;

a release agent comprising an ester wax, wherein the ester wax has a dispersion diameter of from 0.1 to 0.5 μm in a cross-section of the toner dyed with ruthenium; and a wax dispersing agent comprising a hybrid resin, the hybrid resin comprising:

a condensation polymerization resin unit comprising a condensation polymerization product of an aromatic alcohol component and a carboxylic acid component, the carboxylic acid component comprising an aliphatic dicarboxylic acid having 9 to 14 carbon atoms; and an addition polymerization resin unit comprising an addition polymerization product of a styrene monomer;

wherein the toner has an average circularity of 0.95 or less, and wherein the toner has an endothermic peak having an endothermic quantity of from 3 to 10 J/g and said endothermic peak arises from the ester wax.

8. The toner of claim 7, wherein the aromatic alcohol component is represented by the following formula (1)

Formula (1)

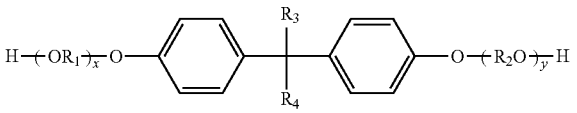

wherein each of R1 and R2 independently represents an alkylene group having 2 to 4 carbon atoms, each of R3 and R4 independently represents a hydrogen atom, a straight-chain or branched alkyl group having 1 to 6 carbon atoms, and each of x and y independently represents a positive integer where the sum of x and y ranging from 1 to 16.

9. The toner of claim 7, wherein alcohol components in the condensation polymerization resin unit consists essentially of the aromatic alcohol component.

10. An image forming method comprising:

charging a photoconductor;

forming an electrostatic latent image on the photoconductor having been charged;

developing the electrostatic latent image into a toner image with the toner of claim 7;

transferring the toner image onto a transferor;

cleaning a surface of the photoconductor with a cleaning member; and fixing the toner image.

11. The image forming method of claim 10, further comprising:

recycling the toner including:

collecting the toner removed from the surface of the photoconductor in the cleaning; and supplying the toner collected in the collecting to the developing.

* * * * *